United States Patent [19]

Sundén et al.

[11] Patent Number: 4,710,270

[45] Date of Patent: Dec. 1, 1987

[54] PAPER MAKING PROCESS UTILIZING FILLERS WITH HARDENED ENVELOPES OF CATIONIC STARCH

[76] Inventors: Olof Sundén, 1, Rue Hotel Dieu, F74200 Thonon, France; Agneta Sundén, 22, Av. General Guisan, 1180 Rolle, Switzerland

[21] Appl. No.: 645,527

[22] Filed: Aug. 29, 1984

Related U.S. Application Data

[63] Continuation-in-part of Ser. No. 373,487, Apr. 22, 1982, abandoned.

[30] Foreign Application Priority Data

Sep. 19, 1980 [EP] European Pat. Off. ..... 8006599-8
Sep. 19, 1980 [EP] European Pat. Off. ..... 8006600-4
Sep. 16, 1981 [WO] PCT Int'l Appl. .... WO81/00147

[51] Int. Cl.[4] ..... D21H 3/20

[52] U.S. Cl. ..... 162/175; 162/177; 162/181.1; 162/181.2; 162/181.3; 162/181.6; 162/183

[58] Field of Search ..... 162/175, 181.1, 181.2, 162/177; 181.3, 181.6, 183, 185

[56] References Cited

U.S. PATENT DOCUMENTS

| | | | |
|---|---|---|---|
| 3,257,267 | 6/1966 | Hay | 162/159 |
| 3,384,536 | 5/1968 | Sandberg et al. | 162/185 |
| 3,873,336 | 3/1975 | Lambert et al. | 162/181.2 |
| 4,115,187 | 9/1978 | Davidson | 162/181.3 |
| 4,147,682 | 4/1979 | Yada et al. | 162/181.3 |
| 4,385,961 | 5/1983 | Suending et al. | 162/181.6 |

FOREIGN PATENT DOCUMENTS

| | | | |
|---|---|---|---|
| 708518 | 4/1965 | Canada | 162/181.2 |
| 1282551 | 7/1972 | United Kingdom | 162/181.3 |
| 2010352 | 6/1979 | United Kingdom | 162/181.2 |

*Primary Examiner*—Peter Chin

[57] ABSTRACT

A paper making process with improved retention and binding of fillers is characterized by the use of an amphoteric mucous compound as binder. The preferred compound is the reaction product between cationic starch (CS) of low charge density and a polysaccharide acid such as carboxymethyl cellulose (CMC). This compound has amphoteric and mucous character and should be used for enveloping fillers, while in a unique transient structure. This structure is characterized by filler particles being enclosed and finely distributed in droplets of the highly hydrated but substantially water-insoluble mucous compound. According to the invention this transient structure should further be reorganized to a less hydrated and more resistant gel structure, still enclosing the filler. This gel structure can stand the draining forces on a paper machine wire screen. This structural reorganization is achieved by reaction with colloidal particles, especially of polyaluminum-oxy-citrate compounds. The process yields paper of high strength and filler retentions of more than 90% at a single wire passage even at extreme filler contents of 30–60% of the paper weight.

6 Claims, No Drawings

PAPER MAKING PROCESS UTILIZING FILLERS WITH HARDENED ENVELOPES OF CATIONIC STARCH

This application is a continuation-in-part of application Ser. No. 373,487, filed Apr. 22, 1982 now abandoned.

The invention relates to an improvement in paper making, consisting of the use of cationic starch (CS) as binder in a transitional and insoluble but highly hydrated form. This transitional insoluble but hydrated form is most easily obtained and kept by reacting swollen powder of CS in water at 60°-90° C. with small amounts of polysaccharide acids of high charge density such as carboxymethyl cellulose (CMC) and alginates. By this reaction, an insoluble and hydrated amphoteric structure is formed, which is related to natural mucous polysaccharide structures dispersed in aqueous phase, the latter being substantially free of molecularly dissolved CS. Like natural mucous structures, this dispersed structure has a strong tendency to adhere to the surface of mineral pigments and to encase them.

The invention is especially characterized by the use of inorganic polymeric colloids, especially colloidal polyaluminum compounds, for a synerese hardening of the dispersed mucous structure, when this has been applied to a furnish of pigment fillers but before this furnish is dewatered together with cellulose on the wire screen of a paper making machine. By this synerese hardening, the mucous encapsulation on the pigment surfaces is hardened to such a degree that it can withstand the heavy drain forces on the paper machine wire screen and provide a high retention as well as a high paper strength even when the filler content of the paper is as high as 30-60%.

A special feature of the invention is that a colloidal amphoteric complex of polyaluminum polycitric acid can be used both for the primary formation of the mucous structure and for its synerese hardening. Thereby the use of CMC or the like can be replaced by the citric acid in the polyaluminum citrate compound.

Cationic starches have long been used in the paper industry, but in small percentages of 0.2-1.0% of the paper weight. According to the present invention, the amount of cationic starch used for paper making can be increased to between 3 and 10% by weight of the paper without process troubles if the cationic starch is applied to a separate filler furnish and subjected to special treatments before paper formation together with cellulose.

The DS (degree of substitution) of CS is very low, mostly 0.015 to 0.050, which means that 1.5 to 5% of the glucose units are substituted with amino groups, mostly quarternary amino groups.

We have obtained the best results with CS of the highest possible molecular weight (100,000-500,000) and a DS of 0.025-0.050 preferably 0.030-0.035, corresponding to an EW (equivalent weight) of about 6,000.

CMC is also available in various molecular weights and DS. Their DS is mostly very high and may vary between 0.040 and 0.90, and we have found the higher DS of 0.60-0.90, preferably 0.70-0.80 best suited for the invention, which corresponds to an EW of around 300. A DS below 0.10 is here called "low" (low charge density) and above 0.50 "high". Further a medium m.w. of 50,000-300,000, corresponding to a Brookfield viscosity of 20-300 cps in 2% solutions, is to be preferred, even if CMC grades outside these limits also can be used.

If one prepares a "solution" of CS (EW 6,000) and CMC (EW 300) at above 100° C. in a 2-3% water solution and in equivalent amounts, that is 5 parts of CMC per 100 parts of CS, one gets a somewhat turbid low-viscosity solution. On standing, a precipitate of CS-CMC coacervate slowly separates. Such a coacervate is precipitated not dispersed and is not an efficient product that can be used according to the invention. For the most efficient product, only about half the amount of CMC or 2-3 parts per 100 CS has to be used, and this CMC should preferably be reacted with CS at only 60°-80° C., yielding a swollen but insoluble structure of mucous. The technically recommended process for dissolving CS above 100° C. by direct steam injection for a prolonged time in order to get a "molecular solution" free of structural agglomerates should definitely be avoided.

As stated above, the most efficient structure of the CS-CMC mucous is obtained when the reaction product is formed during swelling of the starch grains. Technically, it is of advantage to utilize a dry mixture of CS with 2-3 parts of CMC as Na salt. When mixed with cold water, the CMC component then dissolves without formation of CMC lumps, which otherwise causes difficulties. The CS starts to swell at 50°-60° C. with formation of a mucous structure with CMC. "Cooking" of the formed structure at 60°-90° should not be prolonged for more than 10 minutes. The resulting mucous dispersion is somewhat turbid and of much lower viscosity than a solution of CS at the same concentration. The mucous dispersion can be made in a concentration of 2-6% CS by weight. Instead of CMC, other polysaccharide acids such as alginates can be used, even when CMC is specified hereinafter.

The optimum ratio of CS to CMC or any other anionic polymer is not related to any equivalency point or to any fixed relation between anionic and cationic ratio. Of importance is the insoluble character and the organization of anionic and cationic areas inside the mucous structure obtained. For the natural alginic acid with DS=1.0 the optimum ratio is the same as for CMC with DS=0.7 or 2-3 parts per 100 parts of CS. With too low a polyacid content (below CMC/CS=0.5/100 the final mucous structure including filler is weak mechanically and does not give the optimum paper strength. With too high a polyacid content the structure will resist combination with fillers. Polyacid CS ratios above 10/100 are hardly useful, while practical limits are 1-8/100 CS, which yield insoluble mucous structures.

As already indicated, alginic acid from seaweed can be used as a reactant with CS, but CMC seems at present to be the most economical reactant. Also a low molecular weight polyacid like citric acid has a minor but inadequate effect, when used as such as "solvation inhibitor" when CS is cooked. But as described later, polycitric acid compounds can be efficiently utilized according to the invention, when applied in the next hardening step of the process.

The chemical structure obtained by reacting 2 parts CMC (DS 0.7 and MW 150,000) with 100 parts CS (DS 0.03 and MW 300,000) should likely be an ionic bond structure of one central CMC unit surrounded by 20-30 cationic starch units. The viscosity of the structure formed is rather low, which indicates that the coacervate units are collected in larger structures. The primary structure obtained by dissolving CS in a CMC solution has some further interesting properties, as follows:

1. Contrary to pure CS, the structure shows a stable viscosity during prolonged cooking and this viscosity is surprisingly low even after complete swelling. The external water phase contains no dissolved starch when separated and analyzed. The resulting product is, consequently, not a real solution but a suspension of a substantially insoluble mucous compound of anionic-cationic polysaccharides.

2. The external water and the internal mucous structure may show a difference of pH that can be maintained several days until the structure collapses. It is surprising that the primary structure formed has a "membrane effect" that can be kept for so long a time.

3. When the reaction product of CS and CMC is brought into contact with a slurry of filler (e.g. kaolin or chalk) the mucous structure is reorganized while it combines with the filler particles. The reorganization yields a new secondary structure of filler particles finely enclosed by an envelope of mucous in small spherical droplets. This reorganization is accompanied by a strong increase of viscosity. The droplets of mucous enclosing the filler (the secondary structure) easily agglomerate and separate from the external water, which still contains no substantial amounts of dissolved CS or CMC.

The mixing of the primary mucous composition with filler slurry can be performed cold or with a still hot CS-CMC product. pH is not important and may vary between 5 and 9, depending on the filler (kaolin-acidic and chalk-alkaline). A suitable ratio of CS-CMC to filler is 10% but the amount of CS-CMC binder can vary between 2 and 20% of the weight of the filler. An economical optimum is between 5 and 15%. The concentration of the filler suspension may vary between 10 and 30%, and the concentration of the CS-CMC compound may vary between 2 and 4%. Higher concentrations may give lumps of filler with inadequate contact with the CS-CMC binder. Such lumps will give a "dotty" and dusty paper with low surface strength. Lower concentrations may be used, but result in lower strengths of the final paper. Thus, if the primary mucous structure is formed in high dilution, the secondary mucous structure will also be "diluted" and weakened. The secondary structure is likely composed of filler particles finely enclosed in droplets of CS-CMC mucous. The building blocks of this mucous should be the anionic CMC unit in a central position, surrounded by 20–30 cationic CS molecules, kept together by ionic forces between CS and CMC, and extensively hydrated. The peripheral CS branches of this agglomerate will bind to the filler particles and thus cover them with a thick envelope. The filler particles have a size of 1–10 microns, while the mucous unit block should be less than one micron but linked together with other blocks by other CMC units to comprise a giant mucous molecule extending over the whole droplet.

Simple ionic bonds in polyelectrolytes are neither strong nor stable. In biological mucopolysaccharides, stability is reinforced by protein crosslinking. The secondary structure accordingly is not stable. It slowly reorganizes to a less viscous dispersion with coacervate precipitation and finally fades away while the filler particles are redispersed to the external water phase. The secondary structure is thus transitional and must be used no later than 24 to 48 hours after preparation. Chalk loaded structures are especially sensitive to aging. The primary CS-CMC mucous without filler is also transitional. It has the highest absorption power for fillers when newly prepared, but it is still useful after 24–48 hours.

The role of CMC or alginates is mainly to create such ionic bonds within the CS grains, that on swelling these grains are not molecularly dissolved but are transformed to giant hydrated and insoluble mucous droplets, dispersed in water. If pure CS is heated in water at only 70°–80° C. a similar but weaker structure will develop, but it contributes less to the binding of the filler in the final paper, resulting in a lower paper strength.

The secondary structure of encapsulated fillers in droplets of CS-CMC mucous may seem stable in a laboratory test, but it is not strong enough mechanically to withstand the intensive forces of draining on the wire screen of a fast running paper machine. It is therefore necessary to harden or "cure" the secondary mucous structure to a tertiary more resistant gel structure. This is done by a synerese reaction (dehydration) achieved by addition of small amounts of colloidal polymeric particles with very high surface charge. Such inorganic polymers of anionic character are polysilicic colloids with 5–20 $SiO_2$ units per molecule, while certain polyaluminum colloids with two of the three Al-valences hydrolyzed and the third valence bound to a strong acid are examples of suitable cationic polymers. Finally complex polyaluminum-citrate colloids are of special interest. They correspond to a unit formula $Al_4(OH)_8Ci_2^{2+}.SO_4^{2-}$ (Ci=a citric acid equivalent), and are amphoteric polymers with both anionic and cationic surface charges. According to recent investigations (J. Phys. Chemistry 1982 p 3667) the molecular size of these colloids is three times this unit.

The first reorganization of the mucous structure is attained by coarse filler particles (1–10 microns) with a rather weak surface charge, while the second reorganization, the hardening, is attained by colloidal particles (1–10 millimicrons) with a very high surface charge. The principal reactions are in both cases the same: an ionic binding of glucose chains to the surface of particles. The second reaction is much more intensive, however, resulting in the formation of more dense and dehydrated mucous or gel droplets with increased tendency to irreversible agglomeration, that can stand the draining forces.

The structure of hydrolyzed aluminum salts has been described only during the last twenty years. In J. Physical Chemistry 1982, 86, p. 3667–3673, J. Y. Bottero et al. describe aluminum salts which have had 2 of the 3 Al valences hydrolyzed (r=2) as "a polymeric, spherical ion with formula $Al_{13}O_4(OH)_{28}(H_2O)_8^{3+}$ and with an average measured radius of 12.6 Angstrom". Furthermore, the polymer structure consists of a central tetrahedral Al atom symmetrically surrounded by 12 octahedral Al atoms. We have reason to suppose that the polyaluminum-citrate compounds preferably used in our hardening process are of similar molecular size and structure.

According to our continued investigations we have found a complex magnesium polyaluminum citrate with a composition corresponding to the simplified unit formula $Al_{12}(OH)_{27}Ci_9.MgSO_4$ (Ci—citric acid equivalent) to be the most efficient hardening agent. This polyaluminum complex is prepared by dissolving 6 moles of Al sulfate (12 Al) with 3 moles (9 equivalents) of citric acid and 1 mole of magnesium sulfate to form a concentrated solution, which is slowly neutralized with sodium hydroxide under stirring until all the sulfuric acid bound to Al sulfate is neutralized. The resulting product is a slightly viscous solution with surprisingly small amounts of precipitated Al hydrate and with a pH of 4.8–5.2.

A remarkable property of the product is that it does not give any precipitation with ammonium phosphate at pH between 7 and 9. Any common Al salt as well as Mg salt should be precipitated by ammonium phosphate in this way; one must therefore conclude that all the aluminum and all the magnesium is strongly bound to the complex. If the amount of citric acid is reduced to 2 moles per 12 Al, the neutralization must be stopped at pH 4.5. Adding ammonium phosphate then yields some Al-precipitate. If the Mg content is increased to above 1.5 Mg per 12 Al, the addition of ammonium phosphate yields some magnesium precipitation. We therefore have strong reason to believe that the effective hardening complex is $Al_{12}(OH)_{27}Ci_9.1.5\ MgSO_4$. However, effective hardening complexes can also be obtained outside the limits of this formula or between the Al/citric balance of $Al_{12}(OH)_{21-30}Ci_{6-12}(SO_4)_{0-4}$.

The content of Mg is not critical for the hardening action even though Mg speeds up the hardening. The most important effect of the Mg content is the stability of the complex. With 1–2 Mg atoms per 12 Al, one obtains a product that can be industrially stored and transported without decomposition and precipitation of aluminum hydrate gels.

The polyaluminum-polycitric acid complex with high citric content or about 9 citric equivalents per 12 Al (with or without Mg stabilization) is in fact so effective that it may also be used as the hardening agent if the fillers are enveloped by a CS dispersion without CMC or alginate. The polycitric acid component consequently acts as a polyacid, recollecting the CS to insoluble form, which then is hardened in the same step of the process. Even if this modification of the process is practical, it may yield a somewhat inferior-strength paper.

The effectiveness of the polyaluminum-polycitric acid complex with about 9 citric equivalents per 12 Al and Mg stabilization is further made evident by the improvement of the pH-barrier property of the hardened CS-mucous envelope when chalk is used. The pH-barrier property of the filler envelope is improved by the hardening reaction to such a degree that a furnish of chalk filler, enveloped by dispersed CS-CMC or even CS alone, can be mixed with a furnish of cellulose fibers sized with acidic rosin sizing (sulfate rosin plus alum) at a pH of 5–6 without a prohibitive reaction between the chalk and the acidic cellulose furnish. In this way a paper highly filled with chalk or calcenite limestone can be produced with acidic sizing, yielding a paper without destructive $CO_2$ bubbles and with an excellent low Cobb value (hydrophobic paper). In British Pat. No. 1,425,114 it is established that cationic starch and alginates result in an envelope on chalk whiting, which improves the acid resistance of the whiting. But according to our invention a superior resistance is obtained quite outside the weight relations discussed in this patent and even with CS without any coreactant of alginate or CMC.

The second reaction with colloidal polymer particles may be carried out before any cellulosic fibers have been mixed with the filler furnish. It may also be performed after mixing with cellulose fibers, but then allowed to have a reaction time of some seconds before being diluted with backwater in the paper machine. The synerese reaction of the secondary mucous structure to the tertiary gel structure is fast but not spontaneous. It is also possible to divide this second reaction into two steps, one part taking place before mixing with cellulosic furnish and another part after. The latter may be advisable, especially if ground wood fibers are to be used, because wood fibers are contaminated with anionic and lipid compounds that interfere with the reaction.

The amount of colloidal polymer required is rather low, mostly between 1 and 5% of the starch content, which means 0.1–0.5% of the filler weight, calculated as $SiO_2$ or $Al_2O_3$. In most cases 0.1–0.3% is sufficient if the secondary structure is well developed and not aged more than several hours.

The fiber component of the furnish may consist of kraft sulfate or sulphite fibers, preferably refined to a somewhat higher degree than normally used for the type of paper concerned. It can also consist of ground wood fibers. According to the invention a very high filler content of 30–60% of the paper weight can be used without substantial loss of strength and other important properties, which is shown in the following examples.

It is obvious that the invention can be practiced also in other ways than those described as optimal above. For instance, the cationic starch may be swollen in pure water to a certain degree and without prolonged cooking, whereupon the anionic polyacid is added later in the process. This procedure is required if the citric acid of polyaluminum citrate is used as the solubilization inhibitor for CS. Other fillers can be used, for instance talc, titanium dioxide etc., but kaolin and chalk (limestone powder) are the most common and most economical. Especially chalk and calcinite are of interest as they can be combined with acidic rosin sizing of the cellulose furnish when this invention is applied.

Rosin sizing and other sizing e.g. with Aquapel ® for rendering the paper water-resistant do not influence disadvantageously the process, provided that these chemicals are added to the fiber furnish before mixing with the furnish of mucous-enveloped filler. It is of advantage to conduct the formation of the tertiary structure of starch-polyacid-filler in the absence of other anionic, cationic and lipid contaminants.

Cationized starches of various origins can be used such as corn, tapioca, wheat etc. but at least in Europe potato starch is preferred due to low price and suitable types of starch grains.

EXAMPLE 1

20 g of chalk with an average particle size of 4 microns was slurried in water to a 25% slurry. Then an amphoteric mucous dispersion of 2% concentration was prepared in the following way: 2 g of a high viscosity CS was dispersed in cold water (100 ml) in which had been dissolved 0.05 g CMC or 2.5 parts CMC per 100 parts CS. The CS (Perfectamyl PW) had a DS of 0.033, while the CMC (7LF from Hercules Corp.) had a DS of 0.70 and a low-medium molecular weight. This is a very pure product (food grade) which we used in laboratory tests in order to avoid contamination. The mixture was swollen during mild agitation and cooked for 10 min. at 65°–85°, whereupon it yielded a slightly turbid and low viccosity suspension.

The amphoteric mucous dispersion was added hot to the chalk slurry, in an amount corresponding to 10% CS and 0.25% CMC by chalk weight. The mixture formed a finely agglomerated structure, while the mucous composition enclosed the filler particles. After 10 min. a solution of hexasilicic acid was added in an amount corresponding to 3% $SiO_2$ by weight of the CS (and 0.3% by weight of the chalk). The agglomeration turned to a coarser character of 1–3 mm lumps while the water phase turned totally clear. The hexasilicic acid had been prepared by diluting commercial waterglass (ratio 3.3) to a solution containing 2% $SiO_2$ and then neutralizing half the alkali content with sulfuric acid, whereupon the siloxane polymerization was allowed to proceed for 60 minutes before use.

20 g cellulose, bleached kraft, 60% hardwood and 40% softwood refined to 30% SR was suspended in a turmix and mixed with 0.5% Aquapel® by weight of the cellulose. Then the cured starch-mucous suspension was added to the cellulose with intensive agitation. The final furnish then had a composition corresponding to:

| | |
|---|---|
| Cellulose | 47.2% |
| Chalk | 47.2% |
| CS-CMC | 5.12% |
| $SiO_2$ | 0.13% |
| Aquapel® | 0.25% (emulsion) |

The furnish was divided in 10 parts and handsheets were made with a grammage of 100 g/m$^2$. The backwater was controlled and was found to be totally clear. The weight of the 10 handsheets was 42–20 g compared with the dry solid weight of the furnish of 42.12 g. The retention, consequently, was 100% and the paper formation was very good.

The paper properties were:

| | | | |
|---|---|---|---|
| Tensile index | 33 Nm/g | Opacity | 96% |
| Elongation | 2.9% | Brightness | 77% |
| Wax value | 15 | | |

EXAMPLE 2

The same test was made as in Example 1 but with the difference that the 2.5% CMC was replaced by 2.5% alginic acid (DP=300), and the hexasilicic acid was replaced by a polyaluminum complex corresponding to the composition $Al_{12}(OH)_{24}Ci_2(SO_4)_3$ where Ci is a citrate group or 3 equivalents of citric acid. The resulting agglomeration was very fine with quite clear backwater. The paper formation was excellent and the calculated retention of filler was 96%.

Tensile index: 33 Nm/g

Wax value: 16.

EXAMPLE 3

20 g kaolin (dry) English grade E with an average particle size of 2–5 microns was slurried in water to a 25% slurry. To this slurry was added a dispersion of cationic starch (DS=0.035) pasted at 75° to 5% conc. and in an amount corresponding to 11% on the basis of the kaolin. After encapsulation of the filler, a synerese aid of polyaluminum citrate $Al_{12}(OH)_{24}Ci_2(SO_4)_3$ was added in an amount corresponding to 1% $Al_2O_3$ by CS weight.

The same cellulose was used as in Example 1, but with acid rosin sizing. Filler/cellulose=1/1. After having mixed the kaolin suspension with the fiber furnish with moderate agitation, another addition of the above polyaluminum citrate was made corresponding to 1.5% $Al_2O_3$ or 0.15% $Al_2O_3$ based on the kaolin. Again 10 handsheets with grammage 100 g/m$^2$ were made and the calculated retention was 98%. The backwater showed only a very slight turbidity. In order to reach this retention the agglomeration had to be improved by adjusting the pH of the furnish after Al addition to 5.5%. The handsheets showed the following properties: Tensile index 29 Nm/g, Elongation 2.2%, Wax value 13, Opacity 98% and Brightness 75%.

EXAMPLE 4

The following test was performed on an experimental paper machine:

50 kg chalk (4 micron) was dispersed in water to a 25% slurry. Then a slurry of 5 kg CS (DS 0.035) was prepared in 100 liters of water containing 0.12 kg CMC (DS 0.7) of a Swedish SCA-grade called FF20, with a Brookfield viscosity of 20 cps at 2% conc. After 10 min. cooking, the hot CS-CMC product was diluted to 2.5% and added to the chalk-filler slurry, yielding a filler-mucous slurry with 10% CS based on the chalk and 2.4 parts CMC per 100 parts CS.

The filler-mucous slurry was then mixed with 50 kg cellulose (50% hardwood and 50% softwood, refined to 30° SR) to a 4% consistency, and containing 0.4% Aquapel® hydrophobic emulsion. The mixed furnish showed a very fine agglomeration of mucous-filler droplets together with the fibers. To the mixed furnish was then added 1% $Al_2O_3$ by weight of the CS as a complex polyaluminum-citrate-sulfate solution. This complex had been prepared by dissolving 1 mol Al sulfate in 2 lit. water, adding $\frac{1}{3}$ mol of citric acid, and finally adding 5N NaOH over 3 hours corresponding to a neutralization of 5/6 of the sulfuric acid of the Al sulfate. After this addition the furnish agglomerated further and a totally clear aqueous phase was obtained. The furnish was allowed to stand over night. The next day it was charged to the experimental paper machine during addition of another 2% of $Al_2O_3$ in the form of the above Al complex $Al_{12}(OH)_{24}Ci_2(SO_4)_3$ where Ci is a citrate group (3 equivalents).

The furnish was fast draining on the wire screen, and the machine worked without any problems or interruptions. The paper dried very fast and the filler retention was estimated at 91%.

| | | | |
|---|---|---|---|
| Grammage | 65 g/m$^2$ | Gurley | 13 s. |
| Density | 760 kg/m$^3$ | Cobb | 19 g/m$^2$ |
| Tensile index $\sqrt{MS}$ | 32 kNm/kg | Unger b.s./2 | 27 g/m$^3$ |
| Burst index | 2.0 MN/kg | Brightn. b s/s | 77% |
| Tear index $\sqrt{MS}$ | 5.5 Nm$^2$/kg | Opacity | 93% |
| Elong. at break $\sqrt{MS}$ | 2.5% | Filler cont. | 46% |
| Dennison Wax both sides/2 | 16 | | |

EXAMPLE 5

The following test was performed on a large experimental paper machine with a speed of 150 m/h.

100 kg of talc (filler grade) was dispersed in water to a 30% slurry. A further slurry was prepared from 11 kg cationic starch (DS=0.035) and 0.3 kg of CMC (DS=0.70) in 200 liters of water at 75° C. The hot dispersion of CS-CMC was diluted to a 3% dispersion with cold water and then added to the talc slurry, yielding a filler-CS slurry with 11% CS based on the talc. To this slurry was added 0.10% $Al_2O_3$ based on the talc as a complex polyaluminum citrate with a composition corresponding to the formula $Al_{12}(OH)_{27}Ci_3.MgSO_4$ (Ci=citrate group or 3 equivalents).

A cellulose furnish was prepared of 40% softwood sulfate and 60% hardwood sulfate cellulose refined to 27° SR. The cellulose was sized with 0.3% sulfate rosin and 0.3% alum.

The two furnishes were stored separately but were continuously pumped to and mixed in the supply pipe to the paper machine and in the ratio 40% filler and 60% cellulose. To the supply pipe was also continuously added a dilute solution of the above complex polyaluminum citrate corresponding to an amount of 0.20% $Al_2O_3$ by weight of the talc (about 2% based on the CS). This addition of 3% $Al_2O_3$ by weight of CS caused an adequate agglomeration of fibers and fillers. During the machine run the backwater was rather clear and the paper formation was good.

The resulting paper had a grammage of 61 g/m$^2$ and an ash content of 36.5% indicating a filler retention of about 97%. Other paper properties were:

| | |
|---|---|
| Bulk | 1.03 cm$^3$/g |
| Tensile ind. $\sqrt{MS}$ | 31.4 kNm/kg |
| Elong. $\sqrt{MS}$ | 2.7% |
| Cobb value | 19 g/m$^2$ |
| Dennison | 18 |
| Opacity | 82.5% |

EXAMPLE 6

The following test was performed on an experimental paper machine:

100 kg of chalk (filler grade) was dispersed in water to a 30% slurry. Then a slurry of 11 kg CS with DS=0.035 was pasted in 200 liters of water at max. temp. 75°, the water containing 0.3 kg of CMC with DS=0.70 and medium viscosity. The hot solution of CS with the CMC solution inhibitor was diluted with cold water to a 3% CS solution and added to the chalk slurry, yielding a filler-CS slurry with 11% CS by weight of the chalk and 2.7 parts of CMC per 100 parts of CS. To this chalk-CS slurry was finally added a solution of dodecylaluminum-oxi-tricitrate stabilized with Mg sulfate corresponding to the formula $Al_{12}(OH)_{27}Ci_3.MgSO_4$ where Ci means a citrate unit of 3 citric acid equivalents. This resulted in a grainy chalk furnish with chalk particles encapsulated in grains about 0.5 mm in size and with a water pH of 6.2.

A cellulose furnish was prepared of 40% softwood sulfate and 60% hardwood sulfate refined to 27° SR. The cellulose was sized by addition of 0.3% rosin sizing and 0.3% alum and the furnish had a pH of 4.8.

The two furnishes were stored separately and mixed in the proportion of 40% filler and 60% cellulose in the supply pipeline to which also a final addition of the above-described synerese aid was pumped and mixed with the total furnish. All told, the synerese aid was supplied in an amount corresponding to 4% of the cationic starch used, which caused a rather strong agglomeration of fibers and fillers in the headbox. During the machine run the backwater was almost clear with a solid content of 0.03% and a pH of 5.7. The mixing of enveloped chalk with the acidic cellulose furnish caused no problem and the paper was free of gas bubbles and other defects.

The resulting paper had a grammage of 60 g/m$^2$ and a $CaCO_3$ content of 37% indicating a filler retention of about 98% (without return of backwater). The paper properties were:

| | |
|---|---|
| Bulk | 1.23 cm$^3$/g |
| Tensile ind. $\sqrt{MS}$ | 30.3 kNm/kg |
| Cobb | 23 g/m$^2$ |
| Dennison | 14 |
| Opacity | 83.5% |

EXAMPLE 7

This example shows a process for manufacturing the most efficient polyaluminum citrate complex used as synerese hardening aid in the invention.

In 1000 liters of water the following chemicals are dissolved:

| | |
|---|---|
| Al sulfate · 18 $H_2O$ | 666 kg (1 kmol $Al_2(SO_4)_3$) |
| Mg sulfate · 7 $H_2O$ | 61 kg (0.25 kmol $MgSO_4$) |
| Citric acid · 1 $H_2O$ | 105 kg (0.50 kmol) |

The neutralization is performed by a 40% NaOH solution and proceeds slowly for one hour in a vessel with a very efficient stirrer. The temperature should be kept below 75° C. When the neutralization is finished the hot solution has a silky lustrous appearance due to minor amounts of a separate polyaluminum citrate gel phase which slowly disappears if stirring is continued. When stirring is stopped less than 1% of the Al content separates as insoluble Al hydrate precipitate. The pH of the solution will be pH 5.0±0.2.

The polyaluminum citrate complex should then have the formula $Al_{12}(OH)_{27}Ci_9.1.5MgSO_4$ or any multiple or fraction thereof. The only by-product is the sodium sulfate formed during the neutralization. The main part of this can be removed by crystallization at a temperature of 0°–5° C. as Glauber salt, which removal is necessary if the product is going to be shipped or stored at outdoor temperatures. The polyaluminum citrate does not separate at low temperature, but if no magnesium is present the product slowly decomposes and transforms to an insoluble product. In any event it can be used as a synerese aid immediately after neutralization.

The product has the remarkable property of not giving any precipitation when mixed with an ammonium phosphate solution at pH 7–9. This is sure proof that all the aluminum and all the magnesium is efficiently bound to the complex structure and is also proof of the fact that this type of compound is very different from ordinary soluble Al salts even if they can be kept as a (colloidal) solution without visible particles. The product can be dried to a glass-clear plastic which can be redissolved in water.

What is claimed is:

1. In a method for forming paper from an aqueous slurry of cellulosic fibers and a separate slurry of mineral fillers mixed with and enveloped by a dispersion of cationic starch (CS) and carboxymethyl cellulose (CMC) or alginate, the improvement comprising the steps of:

(a) swelling 100 parts by weight CS particles in an aqueous solution of 1–8 parts, by weight, of carboxymethyl cellulose or alginate at temperature-time conditions selected to prevent molecular solubilization of the CS to form an aqueous dispersion of viscous CS droplets that is at least 2% CS by weight, said dispersion of CS droplets being superficially reacted with CMC or alginate, and adding this dispersion to said slurry of mineral fillers prior to attainment of coacervate equilibrium by said dispersion, thereby individually enveloping the filler particles;

(b) adding to said slurry of enveloped mineral fillers, while still in a transitional non-equilibrium state, a synerese hardening compound comprising a solution of a polyaluminum complex having a composition within the stoichiometric formula limits $Al_{1.2}(OH)_{21-30}Ci_{6-12}(SO_4)_{0-4}$, where Ci represents a citric acid equivalent, in an amount of at least 1% by weight of the CS measured as $Al_2O_3$, whereby a synerese hardening reaction is effected and the enveloped mineral fillers become less hydrated and form a strong gel.

2. Method according to claim 1, wherein said polyaluminum complex corresponds to a stoichiometric formula of $Al_{12}(OH)_{27}Ci_{9}.1.5MgSO_4$, where Ci is a citric acid equivalent.

3. In a method for forming paper from an aqueous slurry of cellulosic fibers and a separate slurry of mineral fillers mixed with and enveloped by a dispersion of cationic starch (CS) and carboxymethyl cellulose (CMC) or alginate, the improvement comprising the steps of:

(a) swelling 100 parts by weight CS particles in an aqueous solution of 1–8 parts by weight CMC or alginate at temperature-time conditions selected to prevent molecular solubilization of the CS, thereby forming an aqueous dispersion of viscous CS droplets having a concentration of at least 2% by weight CS, said dispersion of viscous CS droplets being superficially reacted with CMC or alginate, and adding this dispersion to said slurry of mineral fillers prior to attainment of coacervate equilibrium by said dispersion, thereby individually enveloping the fillers particles, (b) adding to said slurry of enveloped mineral fillers, while still in a transitional non-equilibrium state, a synerese hardening compound comprising a solution of a polysilicic acid containing 5–10 $SiO_2$ units per polymer unit, formed by partial neutralization to 40–70% of a dilute water glass ($SiO_2.Na_2O=3.3$) solution such that the $SiO_2$ content is at least 1% by weight of the CS, whereby a synerese hardening reaction is effected and the enveloped mineral fillers become less hydrated and form a strong gel.

4. Method according to claim 1, wherein said cationic starch has a degree of substitution of 0.02 to 0.10 amino groups per glucose unit.

5. Method according to claim 3, wherein said cationic starch has a degree of substitution of 0.02 to 0.10 amino groups per glucose unit.

6. In a method of forming paper from an aqueous slurry of cellulosic fibers and/or fillers, the improvement consisting essentially of the steps of:

(a) adding to said slurry a dispersion of a hydrated but substantially insoluble mucous composition prepared by reacting 100 parts of cationic starch with a degree of substitution of 0.02 to 0.10 amino groups per glucose unit in a hydrated aqueous dispersion with 1 to 8 parts of carboxymethyl cellulose, alginic acid or an acrylic acid polymer with a degree of substitution of 50–100 mol % of acid per glucose or vinyl unit, whereby said cellulosic fibers and/or fillers are coated with said mucous composition, (b) subjecting said mucous composition to a synerese reaction whereby said mucous composition becomes less hydrated and forms a strong gel, said synerese reaction being performed in two steps, each step comprising the addition of a synersis aid to the slurry of coated fibers and fillers, the first step performed at a high concentration of filler and mucous composition by the addition of polysilicic acid as a syneresis aid and the second step performed in a diluted furnish, including fibers, by the addition of a polyaluminum-oxy-compound as a syneresis aid, or in the reverse order with polyaluminum-oxy-compound used as a syneresis aid in the first step and polysilicic acid as a syneresis aid in the second, said syneresis aids being added in amounts corresponding to 1–5% of $SiO_2$. and 1–5% of $Al_2O_3$ calculated on the amount of cationic starch employed, said polyaluminum-oxy-compound having up to two of the three Al valences neutralized and replaced by —O—groups, while the third Al valence in the polymeric structure is bonded alternately to citric and sulphuric acid according to a stoichiometric formula $Al_4O_4.Ci_2SO_4$ wherein Ci represents a citric acid equivalent.

* * * * *